US011180290B2

(12) United States Patent
Sundnes

(10) Patent No.: US 11,180,290 B2
(45) Date of Patent: Nov. 23, 2021

(54) CONTAINER WITH MULTIPLE COVERS

(71) Applicant: John Phillip Sundnes, Aliso Viejo, CA (US)

(72) Inventor: John Phillip Sundnes, Aliso Viejo, CA (US)

( * ) Notice: Subject to any disclaimer, the term of this patent is extended or adjusted under 35 U.S.C. 154(b) by 0 days.

(21) Appl. No.: 13/771,082

(22) Filed: Feb. 20, 2013

(65) Prior Publication Data

US 2013/0233874 A1 Sep. 12, 2013

Related U.S. Application Data

(60) Provisional application No. 61/601,520, filed on Feb. 21, 2012.

(51) Int. Cl.

| | |
|---|---|
| ***B65D 43/16*** | (2006.01) |
| ***B65D 43/22*** | (2006.01) |
| ***B65D 21/02*** | (2006.01) |
| ***B65B 5/00*** | (2006.01) |
| ***B65D 43/02*** | (2006.01) |
| ***B65D 55/16*** | (2006.01) |

(52) U.S. Cl.

CPC ..... *B65D 43/16* (2013.01); *B65B 5/00* (2013.01); *B65D 21/0233* (2013.01); *B65D 43/0212* (2013.01); *B65D 43/0216* (2013.01); *B65D 43/0218* (2013.01); *B65D 43/22* (2013.01); *B65D 55/16* (2013.01); *B65D 2543/0074* (2013.01); *B65D 2543/00092* (2013.01); *B65D 2543/00194* (2013.01); *B65D 2543/00231* (2013.01); *B65D 2543/00388* (2013.01); *B65D 2543/00462* (2013.01); *B65D 2543/00509* (2013.01); *B65D 2543/00527* (2013.01); *B65D 2543/00537* (2013.01); *B65D 2543/00555* (2013.01); *B65D 2543/00629* (2013.01); *B65D 2543/00796* (2013.01)

(58) Field of Classification Search

USPC ..... 220/826, 822, 819, 834, 836, 837, 839, 220/831, 832

See application file for complete search history.

(56) References Cited

U.S. PATENT DOCUMENTS

| | | | | | |
|---|---|---|---|---|---|
| 745,322 | A | * | 12/1903 | Burrough | 220/324 |
| 3,127,225 | A | * | 3/1964 | Oehrlein | 312/50 |
| 3,245,573 | A | * | 4/1966 | Bakos | B65D 1/243 220/510 |
| 3,282,462 | A | * | 11/1966 | Box | 220/826 |
| 3,463,345 | A | * | 8/1969 | Bockenstette | B65D 21/064 206/508 |
| 4,282,983 | A | * | 8/1981 | Swartzbaugh | 220/832 |
| 4,643,327 | A | | 2/1987 | Campbell | |

(Continued)

*Primary Examiner* — Jeffrey R Allen

(74) *Attorney, Agent, or Firm* — Moser Taboada

(57) ABSTRACT

A storage container comprised of a container bottom, and with multiple sealable covers, configured to connect the covers to the container bottom in both open and closed arrangements. Additionally, each of said covers will seal to the container bottom, and each of said covers will seal to an opposing cover. The containers may be proportioned to stack or nest into other open containers, as well as on top of containers with closed covers. The containers may also allow open covers to rest vertically alongside the container without significantly contacting the surface the container is resting on.

18 Claims, 16 Drawing Sheets

(56) References Cited

U.S. PATENT DOCUMENTS

| | | | | |
|---|---|---|---|---|
| 5,036,994 | A | 8/1991 | McElroy | |
| 5,312,011 | A * | 5/1994 | Fischer | 220/528 |
| 5,967,322 | A * | 10/1999 | Apps | B65D 21/064 206/497 |
| 6,308,858 | B1 * | 10/2001 | Koefelda | 220/608 |
| 6,766,918 | B1 | 7/2004 | Bogdanovich | |
| 7,392,907 | B2 | 7/2008 | Herbert | |
| 2006/0032859 | A1 * | 2/2006 | Cadiente | 220/826 |
| 2008/0190951 | A1 | 8/2008 | Gallagher | |

* cited by examiner

CONTAINER WITH MULTIPLE COVERS

RELATED APPLICATIONS

This application claims the benefit of provisional patent application No. 61/601,520 filed Feb. 21, 2012 by the present inventor.

BACKGROUND

Field of Invention

This invention relates to sealable containers, with smaller sizes typically used for storing food, and larger sizes such as used for storing items like clothing. Commonly used containers are available from such brand names as Tupperware™, Rubbermaid™ or Glad™ reusable storage containers. These containers are generally designed for single or multiple uses, with individual, separate covers that are pressed onto the container, creating a water tight seal. Generally, these containers can stack upon one another. A common problem in many households, is how to organize the various covers of the empty containers, because when you remove the cover, it is separate of the container. This allows covers to become lost, and finding the right cover for the right container can prove to be a daunting task. Manufacturers of these containers have long sought a clever means to keep the right sized cover close to the right sized container. Even the best organization in an individual's cabinet, can still leave missing covers, such as in a dishwasher or a spouse's lunch box. Over time, there is usually a mismatched mess of containers and ill-fitting covers that needs to be replaced.

This invention serves to solve this issue in a novel way, by utilizing multiple covers which are attached to and hinge from the container, thus keeping the covers attached to the container at all times while the covers are open or closed. The covers are designed to seal to the container, and also to seal to one another, whereby 2 or more smaller covers can be joined into 1 larger cover.

Additionally, the containers may be made in a proportion which allows the open covers to rest vertically alongside the container while open, thus an open container would take up no more space on a counter with the covers open as it did with the covers closed.

The result is a nestable, stackable, easy to manufacture and easy to maintain storage container system which ends the issue of lost covers.

Description of Prior Art and Related Applications

U.S. Pat. No. 4,643,327 utilized a singular cover with a hinge in the center. This is designed to allow one half of the cover to be opened while the other half is closed. However this arrangement does not provide for substantial air or liquid sealing, it does not utilize two separate covers where each is hinged to the container. This patent utilizes one cover, which has two parts joined together by a hinge mechanism (thus you cannot separate the two parts). It is essentially an individual folding cover, of where there are several designs.

U.S. Pat. No. 5,036,994 utilizes a single cover that is elastic and stretchable, but does not connect the cover to the container such that when the container is open the cover is still connected to the container. This patent also does not provide for two or more covers, nor does it connect or tether the cover to the container permanently.

U.S. Pat. No. 6,766,918 utilizes a single captive cover attached to the storage container. However, this arrangement utilizes one cover only, meaning when opened, the size of the container and the size of the opened cover next to it will be twice the size of the container itself. In other words, if the container is 12"×12" square, and the cover is fully opened and connected to the container, the opened cover and the container side by side will be 12"×24". This arrangement also does not mention multiple covers, nor does it mention any sealing element to seal multiple covers to one another.

U.S. Pat. No. 7,392,907 utilizes a singular cover with a central hinge element, to allow the cover to fold in half and be stored within the container when not in use. This invention depicts numerous arrangements of the foldable covers, but these covers essentially constitute a "hinge" in the center, whereas the cover is still one cover. The single cover merely has a flexible hinge arrangement allowing it to be folded and placed inside the container. It depicts a sealing mechanism from the cover to the container, in the form of an elastic, removable gasket that stretches around the perimeter of the singular cover. This design does not tether the cover to the container.

US2008 0251526 (Patent Application) uses a small cover, mounted to and within the surface area of an individual, primary cover (see FIG. 2 of this patent) which is hinged to the container below. The small cover functions as a window inside the larger cover, and the small cover is not connected to nor seals to the container itself, it only seals to the primary cover.

US 2008 0190951 (Patent Application) again shows a singular cover with a hinge element in the center, and able to connect to a container below. It does not show two separate covers, connected to the container, and it does not depict any sealing arrangement to join the separate covers together.

SUMMARY OF THE INVENTION

In accordance with the present invention, I propose a storage container that utilizes multiple covers, each connected to the container in both open and closed positions by a hinge or flexible element like a tab, which multiple covers seal to each other, and also seal to the container. Utilizing multiple covers with a sealing mechanism to join them together, allows the covers to be smaller in size. For example, a 12"wide×12"long container can be covered by two (2) covers that are approximately 6" wide×12" long each. If the container base is at least 6" deep, the geometry will allow the covers when open to rest alongside the container and take up little to no additional space when the covers are open. Also, attaching the covers to the container with a living hinge or flexible tab keeps the lids connected with the container, which ensures the lids are never lost, and are always the right size! Making the circumference of the bottom of the container smaller that the circumference of the top allows nesting of the containers within each other, which provides for ease of storage for multiple containers with their covers. These containers can be made circular, square, or any number of different geometric shapes and sizes. It is possible to mold the container and the lids from plastic or rubber with a flexible hinge element in a single manufacturing process, so the containers can be made inexpensively. Also, it is possible to make the containers out more rigid resins or glass, and make the lids of a similar or alternate material, such as a glass container bottom with rubber tops, where the tops are connected to the sides of the glass container. The containers can also be made of cellulose such as paper, or various foams or bio plastics to make disposable versions in expensively.

There are numerous ways and nuances to link the covers to each other, and link them to the container. Three different types of linking/sealing mechanisms are shown in this application, each with various embodiments. One is a compression arrangement where the two covers press into one another in the center to create a seal, where the opposing sides press against the perimeter edge seal of the container.

Another is a tension arrangement where the two covers essentially hook together in the center, and the edge seal is pulled from one side to the other to form a tight seal and maintain tension in the center "hooked" area. This can utilize a protrusion and recess type of perimeter link/seal, or a simple overlapping perimeter link/seal.

Another method to seal a cover to another cover is to utilize an elongated pocket type arrangement where one element snugly fits into the other element, such as a protrusion and recess (a male and female). In this arrangement the female portion of the pocket will compress or clamp down on the male portion, without additional need for tension or compression forces from the surface of the cover.

A preferred embodiment is an arrangement where the seal can be made above the surface plane of the cover, allowing human fingers to access the elongated seal and pinching the two elements of the seal together above the lid.

Accordingly, there are any number of configurations and types of sealing or linking elements which can be utilized to join the covers to the container, and join one cover to another cover.

The protrusions do not need to be formed or rolled, they may be solid or formed protrusions, which mate to recesses to create a link.

OBJECTS AND ADVANTAGES

Accordingly, several objects and advantages of the present invention are:

(1) To provide a container with covers that link or seal to close it (2) To provide a container whose covers are attached to it with a flexible member or hinge element, thus eliminating the issue of losing the covers and rendering the container unable to close.

(3) To provide containers who stack efficiently for storage.

(4) To provide containers whose covers (when open), can rest vertically alongside the container so that the open container takes up little more space than when the covers are closed.

(5) To provide a process where a container and its lids can be created at the same time in a manufacturing process from the same material, which ends any management of counting, storing, shipping and selling same quantities of lids with the same quantities of containers, as they are always connected together.

BRIEF DESCRIPTION OF THE DRAWING FIGURES

In the drawing figures, closely related figures have the same number but different alphabetic suffixes.

FIG. 1 depicts an isometric view of a container with both covers in the closed position. There are raised elements in the center of each lid to form a flat surface in the same plane as the top of the cover to cover link element, so that other containers may rest upon a flat surface. These raised elements also serve to increase the rigidity of the lid.

FIG. 5 depicts and underside version of the cover to cover transition, showing how the cover to cover transition creates a continuous connection recess for the container edge condition to mate to.

Figure 10:
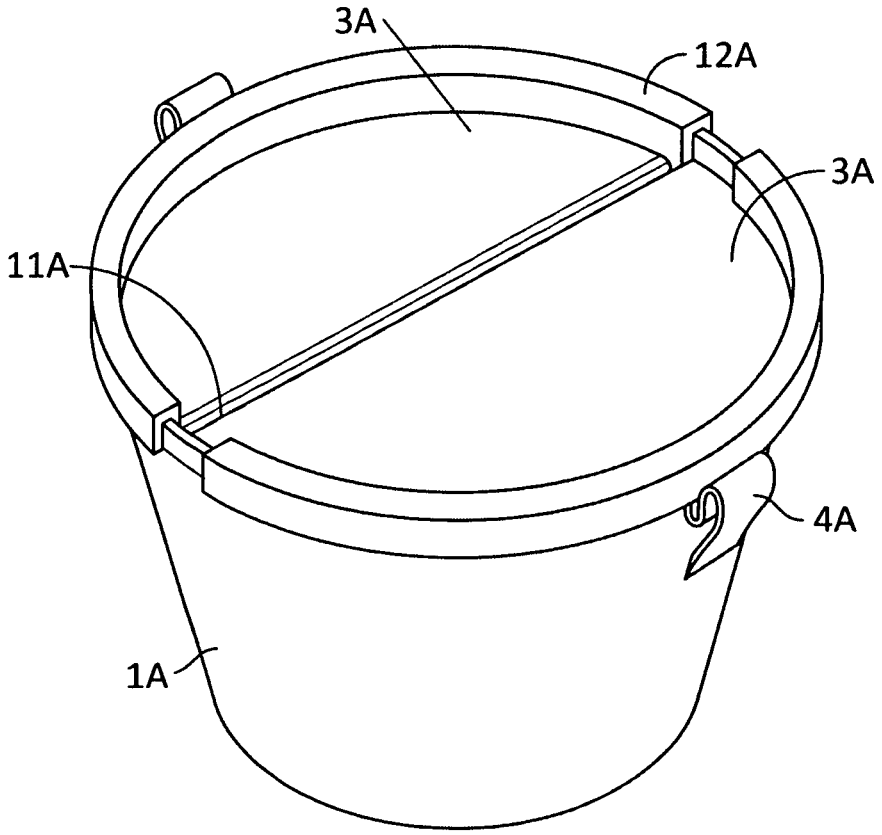

FIG. 10 shows a multiple cover container with the covers closed. This arrangement uses two covers that "hook" together, with tension pulling them to opposite ends of the container. These covers are also connected to the container via a flexible tab element, to ensure that the right cover is always with the right container.

Figure 11:
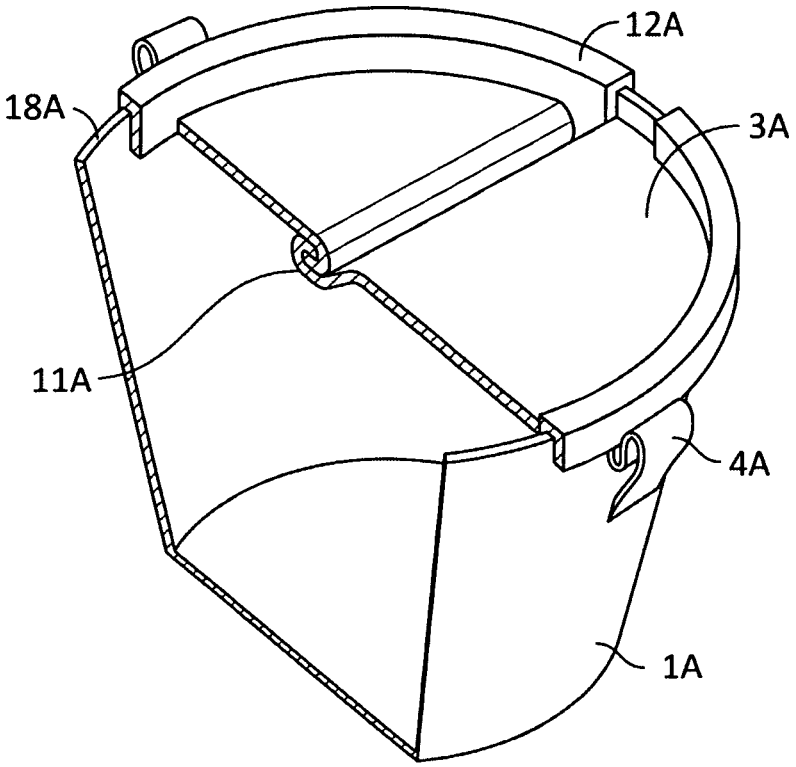

FIG. 11 depicts this same multiple cover container in FIG. 10, in perspective view with a section cut through it. This shows the perimeter edge of the covers as a protrusion of the container edge fitting into a recess of the cover edge, thus sealing around the edge of the container. The elongated hook configuration of the multiple covers pulls on one another as the covers are pulled over the edge of the container.

Figure 12:
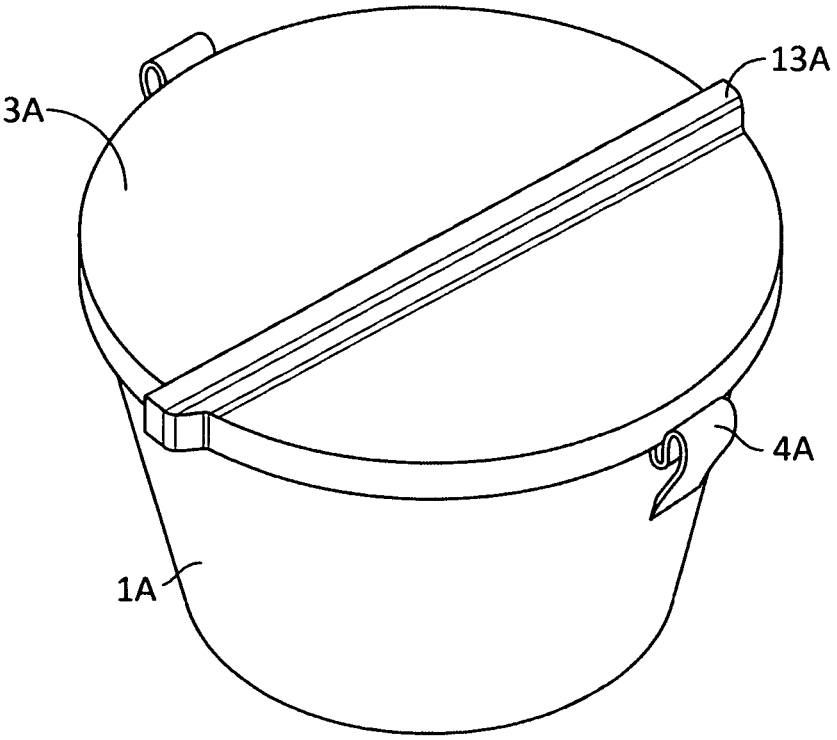

FIG. 12 depicts a similar "hook" type center sealing element with the covers closed. In the perimeter cover to container link the edge of the cover simply overlaps the sides of the container with tension creating the link or seal.

Figure 13:
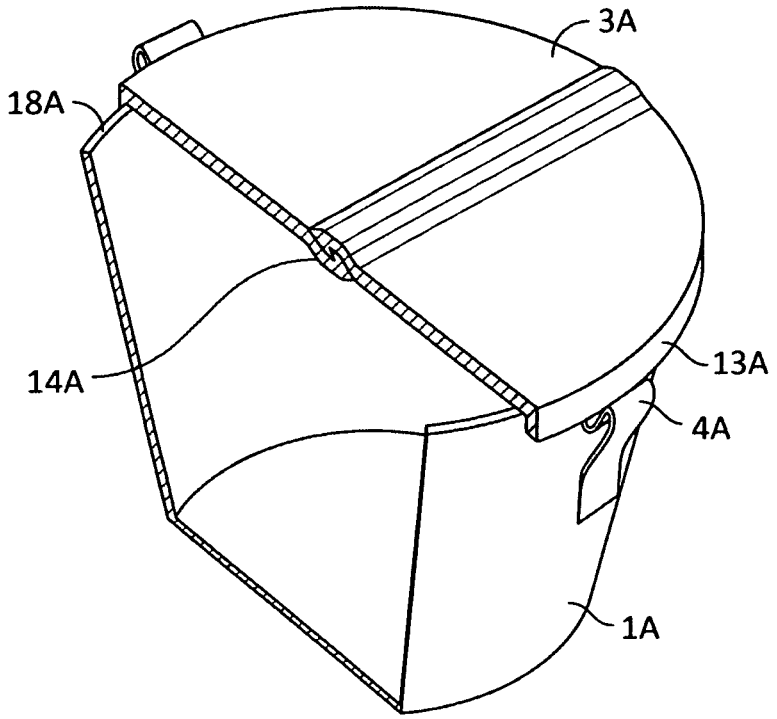

FIG. 13 shows this same "hook" type of central sealing in cut way, depicting the central link element, and showing the perimeter edges of the covers sealing around the container. In this figure the edge seal of the cover doesn't sandwich over both sides of the container edge as is FIGS. 10 and 11, rather, there is simply an edge that drops down around the outside edge of the container with tension of the covers pulling it towards the center of the container to seal it.

Figure 14:
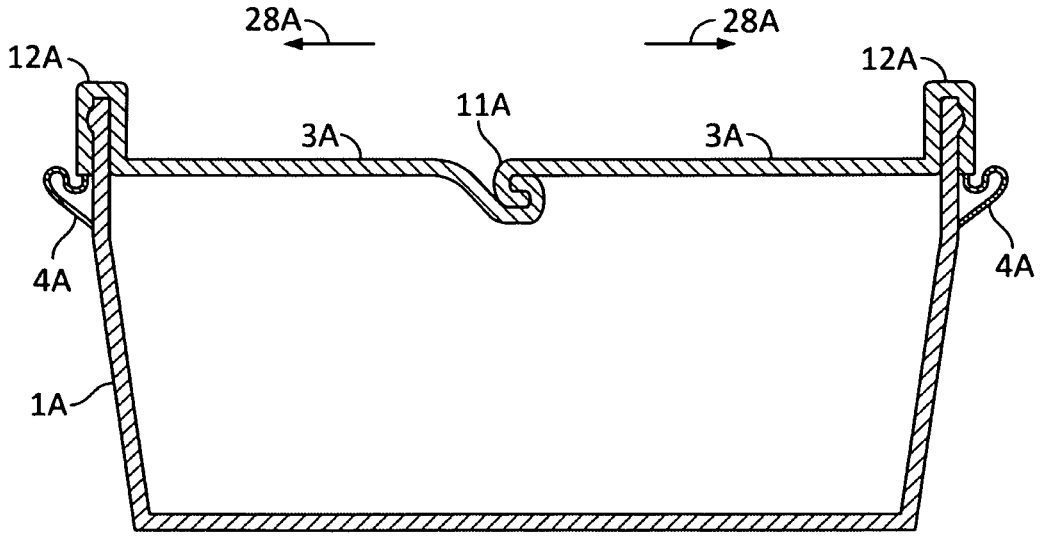

FIG. 14 depicts the container depicted in FIG. 11 in full section view, showing the cover capture of the edge of the container, and the flexible elements/hinges connecting the covers to the container. Here the tension forces are shown pulling in opposite directions, thereby pulling the elongated hook elements together.

Figure 15:
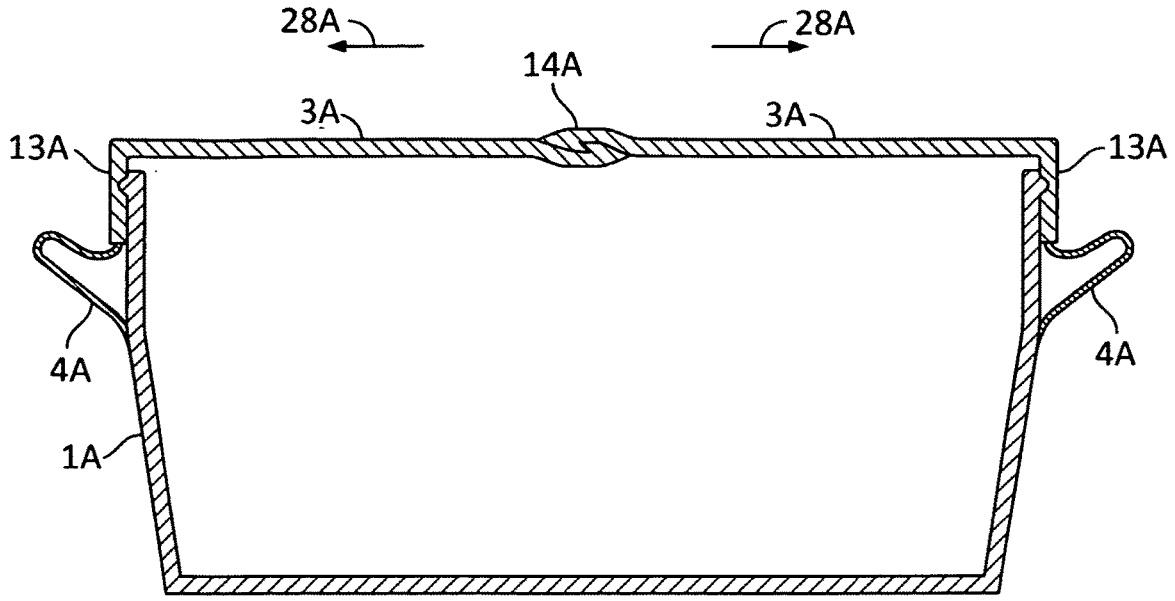

FIG. 15 depicts the container embodiment of FIG. 13 in section view, showing the elongated "hook" sealing element in the center and the overlapping cover arrangement over the edges of the container.

Figure 16:
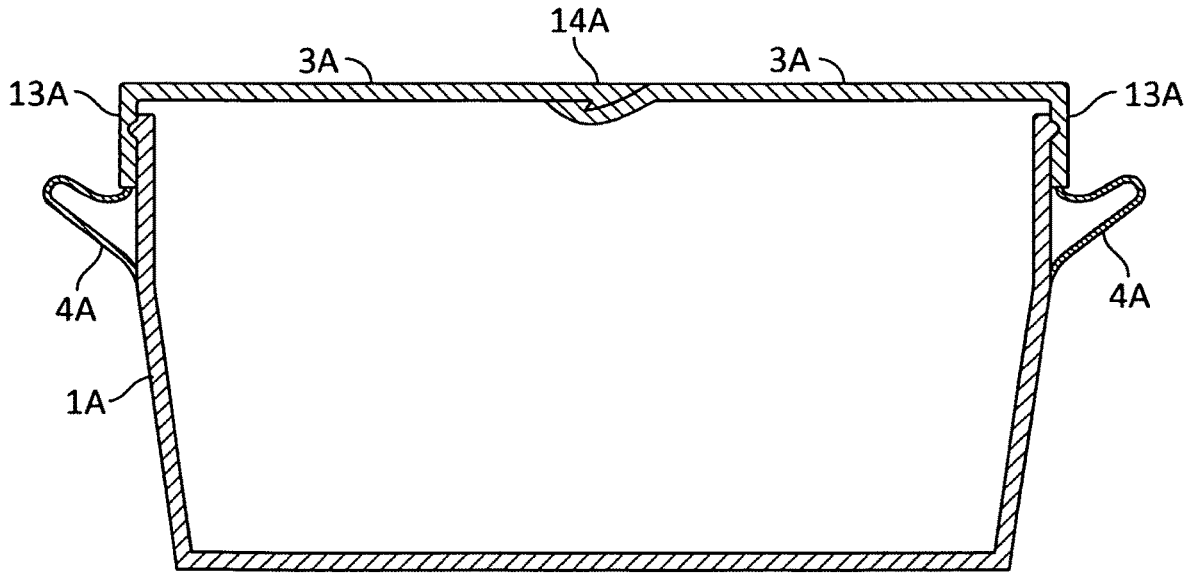

FIG. 16 depicts an elongated hooked arrangement in a manner that keeps the top of the cover flat to ease stacking of closed containers.

Figure 17:
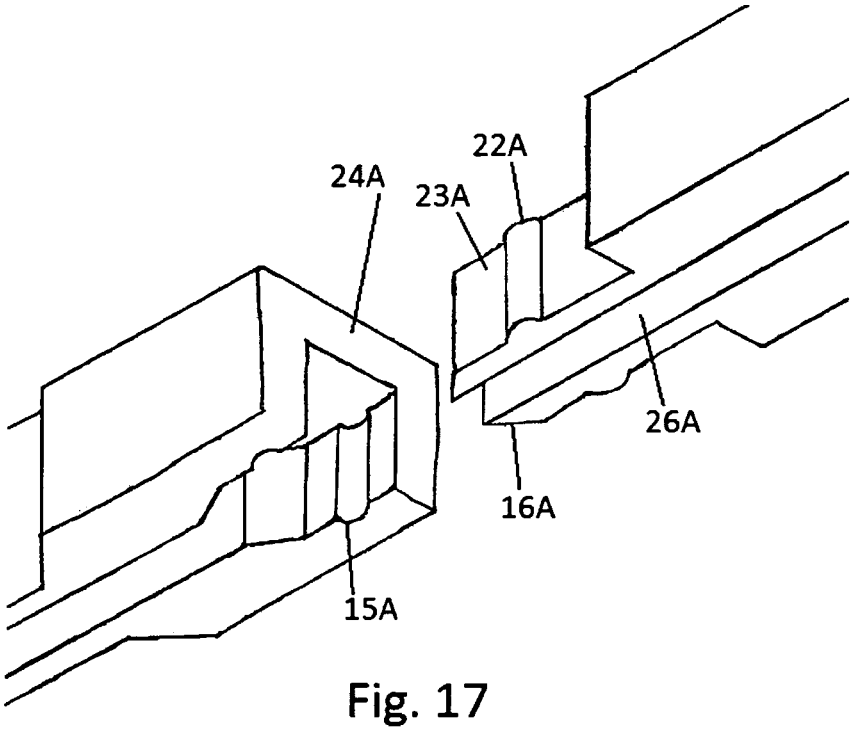

FIG. 17 depicts the overlapping perimeter cover edge seal of FIGS. 10, 11, and 14 in more detail, where the two cover edge seals overlap each other at the container edge.

Figure 18:
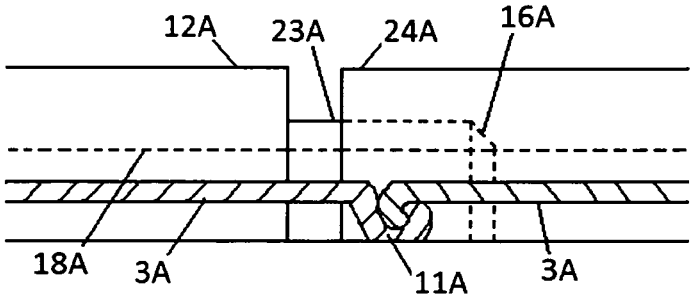

FIG. 18 depicts the overlapping perimeter edge seals in side elevation, showing the smaller male part of one cover seal fitting inside the larger female part of the other cover edge seal.

Figure 19A:
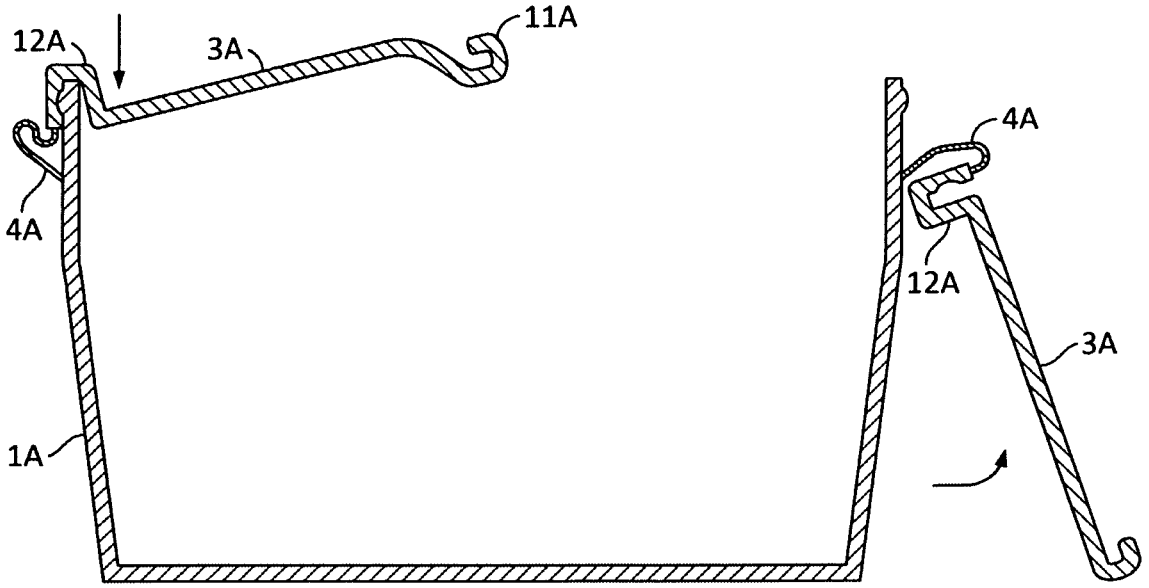

FIG. 19*a* depicts a container in operation with the cover to cover hook seal arrangement partially open.

Figure 19B:
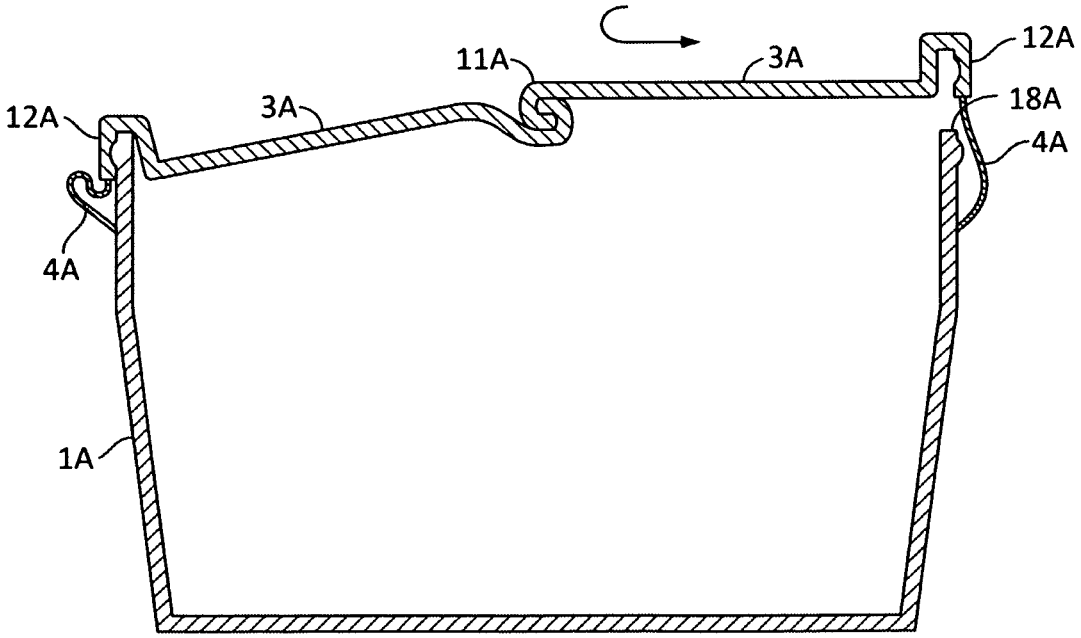

FIG. 19*b* depicts a container in operation with the cover to cover hook seal arrangement being joined together in the center and pulling to the opposite side.

Figure 19C:
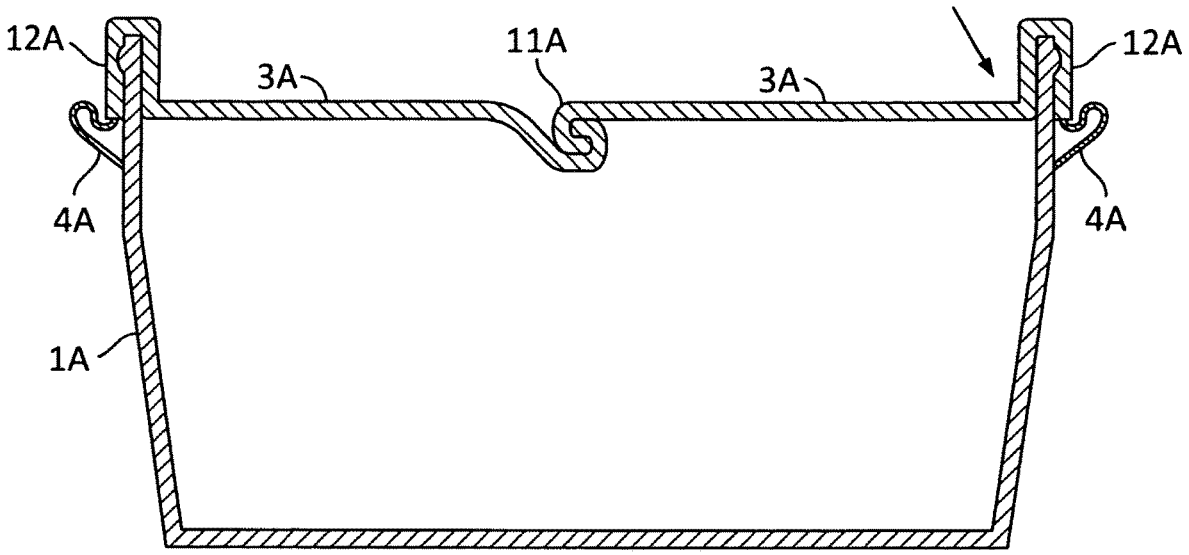

FIG. 19*c* depicts a container in operation with the cover to cover hook seal arrangement is joined in tension, and whose edge seal is pressed over the container edge.

Figure 20:
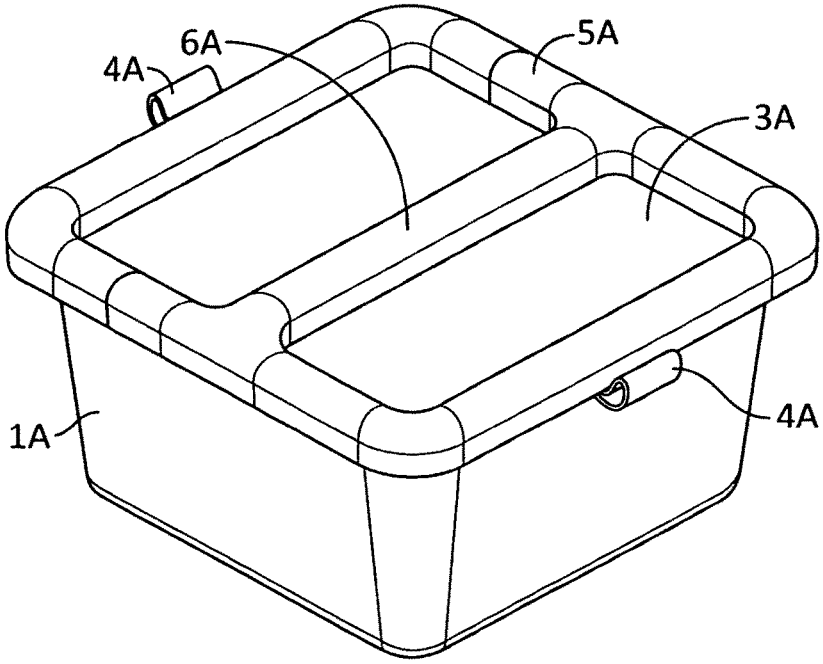

FIG. 20 depicts an embodiment of a container with a protrusion and recess sealing configuration in a perspective view, showing the multiple covers closed, and the flexible elements connecting the covers to the container. There is a seal formed between the covers and the container around the perimeter, and central sealing in the center where the two covers meet.

Figure 21:
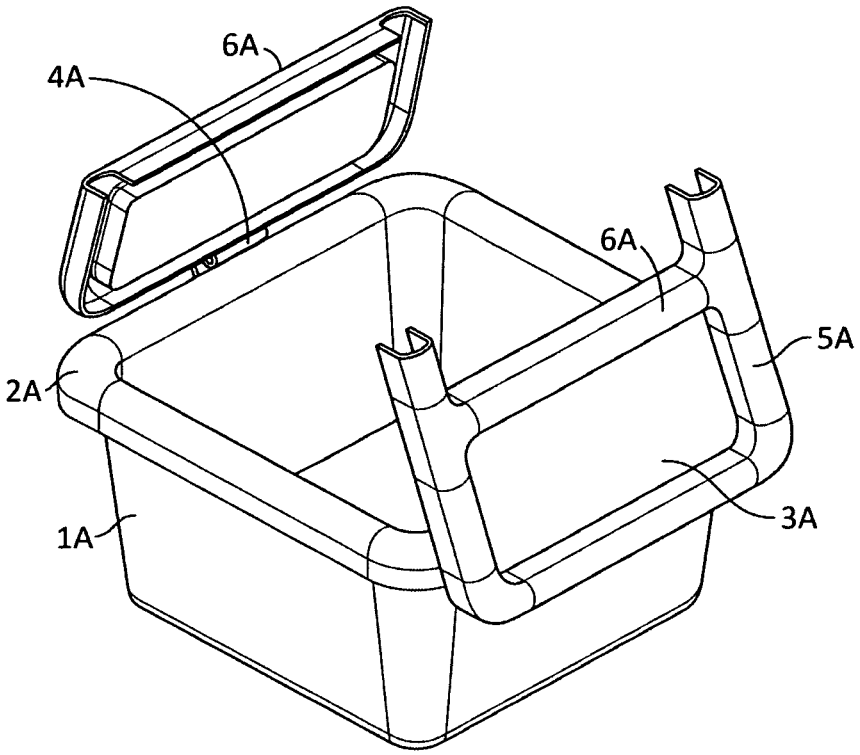

FIG. 21 depicts this same embodiment of the container with the multiple covers partially open. This shows the overlapping seal in the center of the container.

Figure 22:
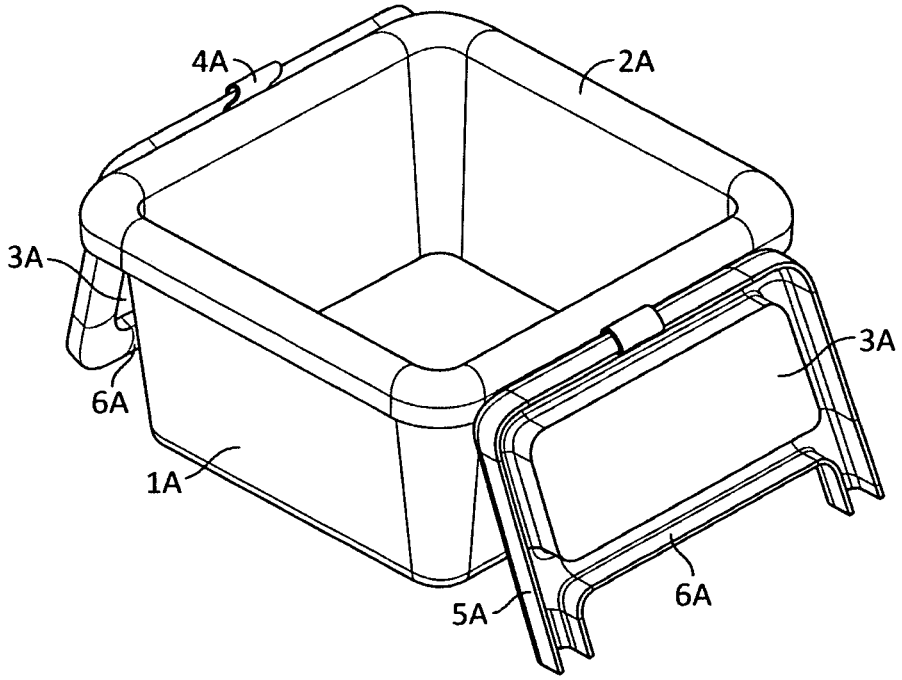

FIG. 22 depicts this same embodiment of the container with the covers fully open to either side of the container, allowing them to rest vertically and neatly on either side, and therefore taking up minimal additional space on the surface (i.e. a table or counter) the container is placed on.

Figure 23:
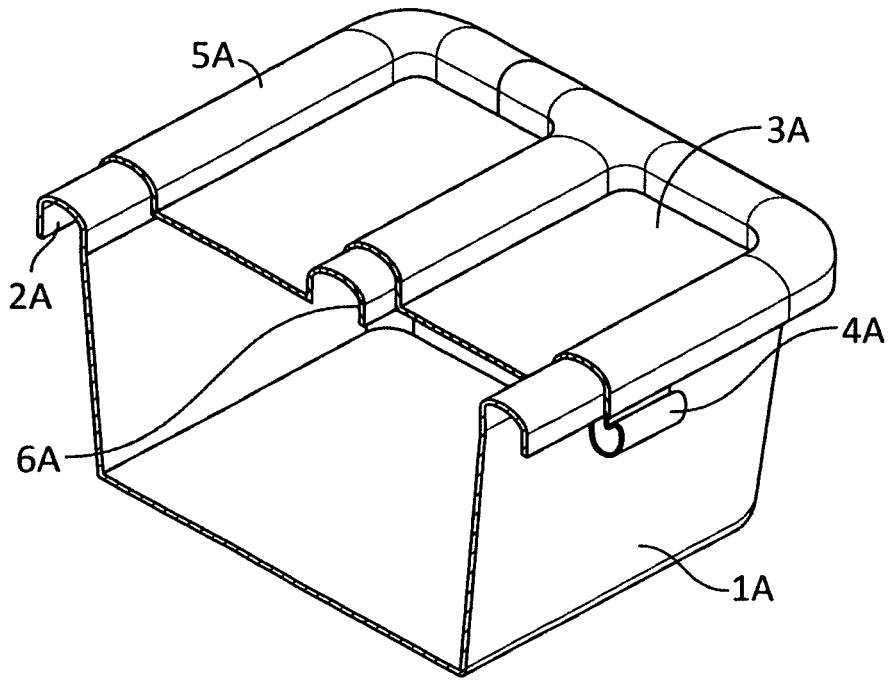

FIG. 23 shows a section through the container in perspective view, showing the overlapping covers closed, with the pocket seal in essentially the middle of the container.

Figure 24:
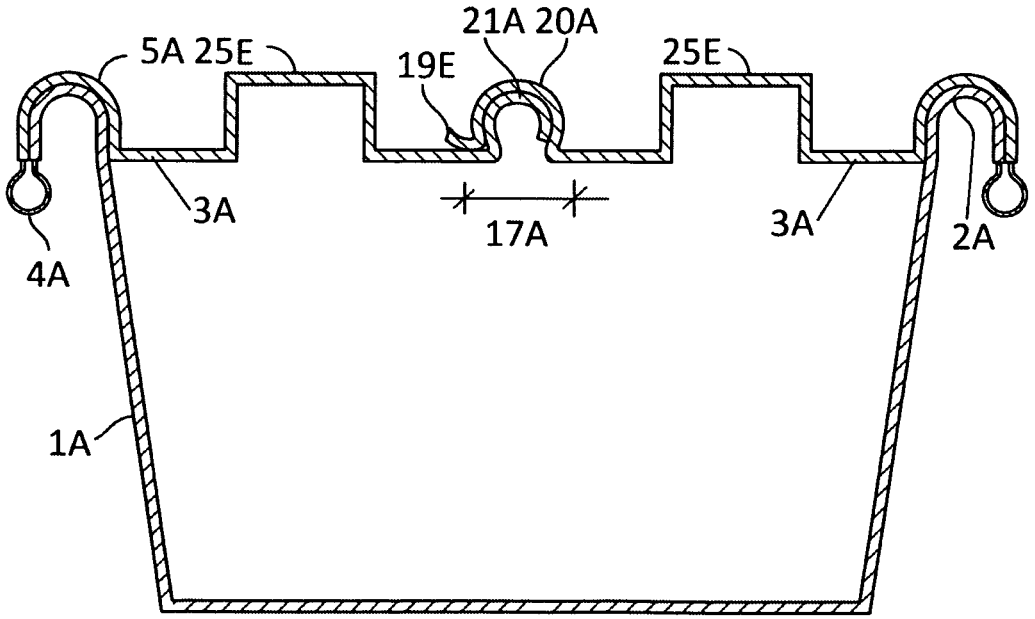

FIG. 24 shows a section of the container, depicting overlapping covers and the hinge/tethered elements on either the side. This Figure also shows raised sections of the lid surface, to create a flat plane for another container to stack on top when this container is closed.

Figure 25A:
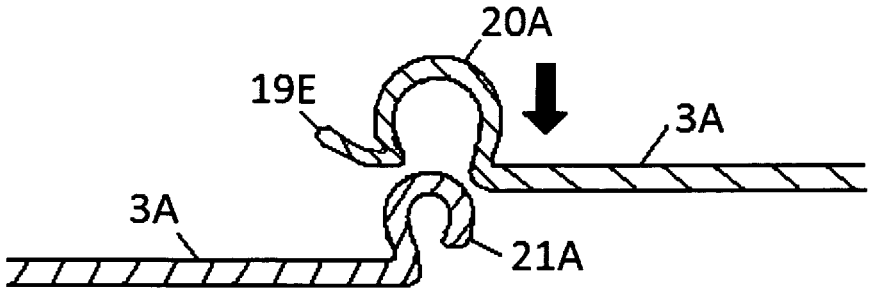

FIG. 25*a* depicts the locking seal arrangement with the female portion over the male portion.

Figure 25B:
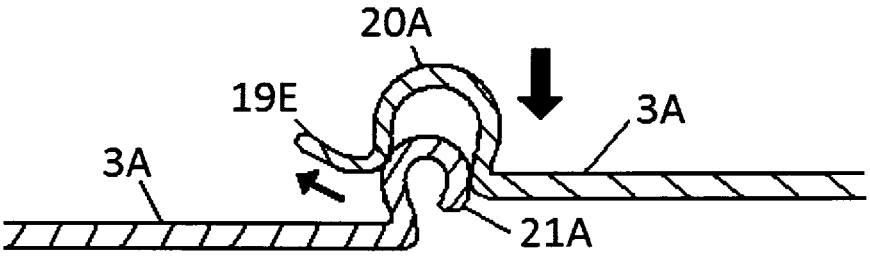

FIG. 25*b* depicts the elongated protrusion and recess seal arrangement with the recess portion being pressed over the protrusion portion and widening the opening in the recess portion.

Figure 25C:
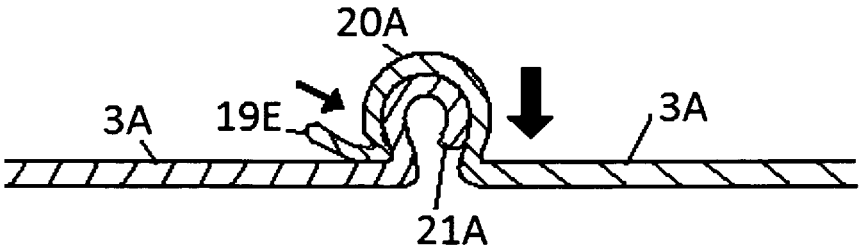

FIG. 25*c* depicts the locking seal arrangement with the recess portion being pressed fully over the protrusion portion showing the opening in the recess portion closing over the protrusion portion.

Figure 26:
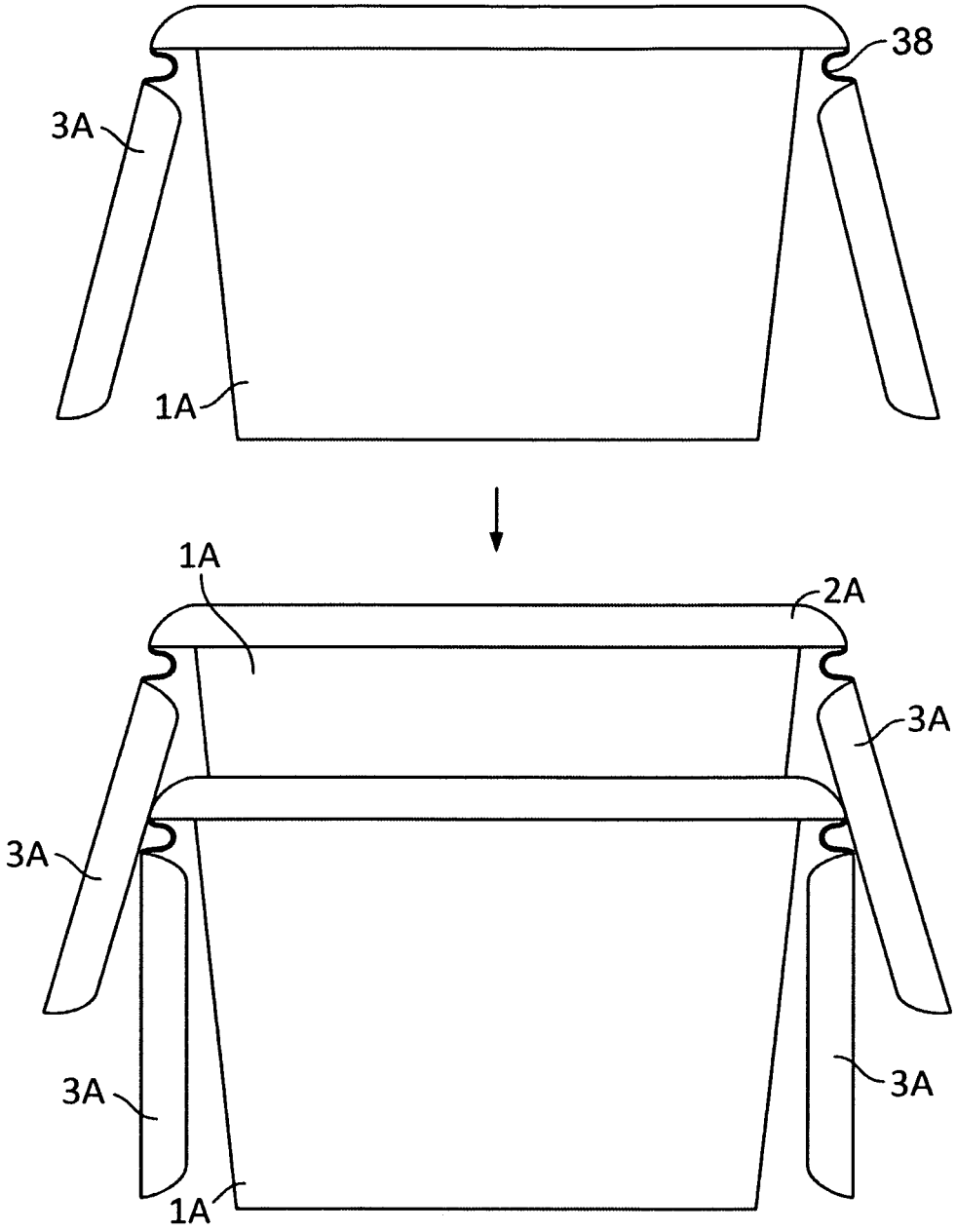

FIG. 26 shows multiple containers in elevation view, showing their nesting capability. Multiple containers can be stacked together with covers attached and opened, utilizing a storage area only slightly larger than the containers themselves.

Figure 27:
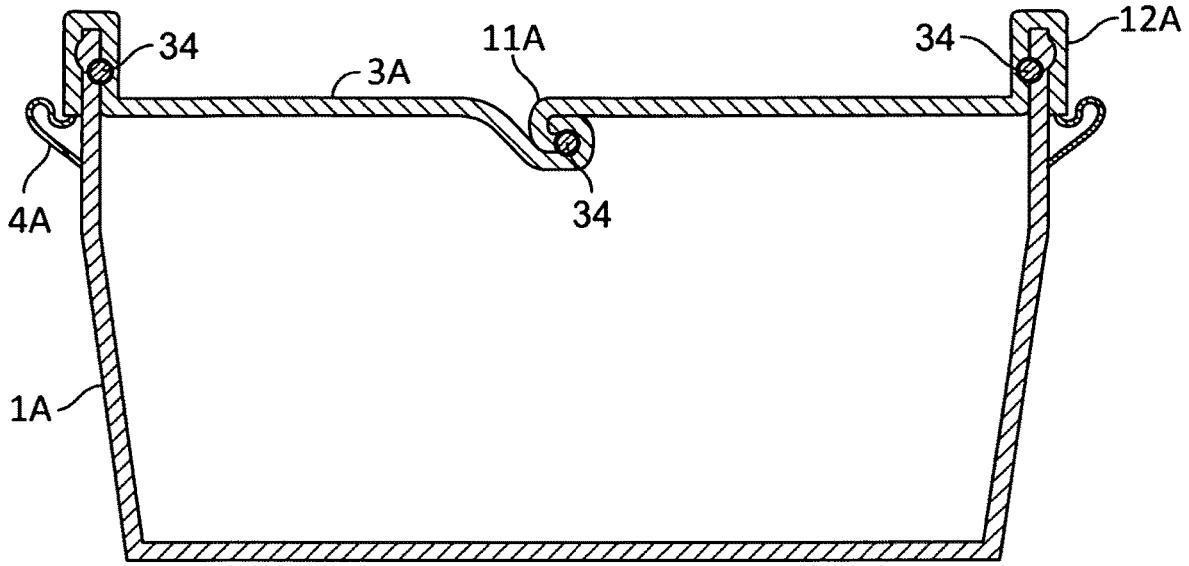

FIG. 27 shows a container in section view, with flexible gasket elements in various locations such as the cover to container edge location, or cover to cover location.

Figure 28:
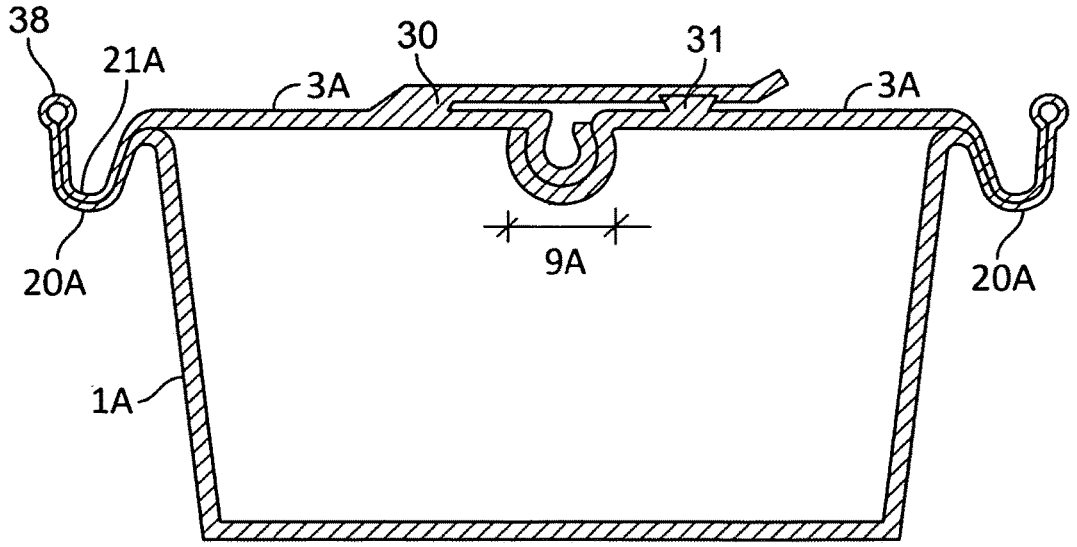

FIG. 28 shows an alternate embodiment of the covers where the recess and protrusion seal at the perimeter is reversed, with the recessed element of the container curving downwards in lieu of upwards. The covers seal into the container by pushing down into them, in lieu of over them. This alternate embodiment also shows at least one latching device which can pull from one cover to an attachment element in the other cover, thus locking the two covers together besides the elongated sealing element.

DRAWINGS REFERENCE NUMERALS

| | |
|---|---|
| 1A | Container |
| 2A | Container perimeter link/seal element |
| 3A | Cover surface bottom plane |
| 4A | Cover to container flexible member connection |
| 5A | Protrusion and recess link/seal element around perimeter of container |
| 6A | Central cover to cover protrusion and recess link/seal element |
| 7A | Locking cover to cover link/seal layout |
| 8A | Compression type cover to cover link/seal layout |
| 9A | Reversed cover to cover link/seal layout |
| 10A | Reversed perimeter link/seal layout |
| 11A | Tension type cover to cover link/seal layout with elongate hook element |
| 12A | Cover to container edge link/seal |
| 13A | Overlap configuration of cover to container edge link/seal |
| 14A | Hook type cover to cover link/seal |
| 15A | Cover to cover overlap edge link/seal recess to receive protrusion element |
| 16A | Beveled edge of cover to cover link/seal connection |
| 17A | Clamping pull tab link/seal assembly |
| 18A | Container edge |
| 19E | Pull Tab to release clamping elongated link/seal |
| 20A | Recess element at protrusion and recess type link/seal |
| 21A | Protrusion element of protrusion and recess type link/seal |
| 22A | Protrusion element at cover to cover overlap connection |
| 23A | Male cover to cover overlap link/seal element |
| 24A | Female cover to cover overlap link/seal element |
| 25E | Cover protrusion raised plane |
| 26A | Recess at edge of cover to receive the edge of the container. |
| 28A | Tension forces pulling cover elements together |
| 29 | Compression forces pushing cover elements together |
| 30 | Latching element |
| 31 | Latching receptacle |
| 32 | Container protrusion attachment element |
| 33 | Cover recess to link to container protrusion attachment element |
| 34 | Flexible gasket element |
| 35 | Overlapping cover to cover link/seal at perimeter |
| 36 | Part A of a two part cover to cover compressive link/seal arrangement |
| 37 | Part B of a two part cover to cover compressive link/seal arrangement |
| 38 | Living hinge element |

DETAILED DESCRIPTION OF DRAWINGS

Figure 1:
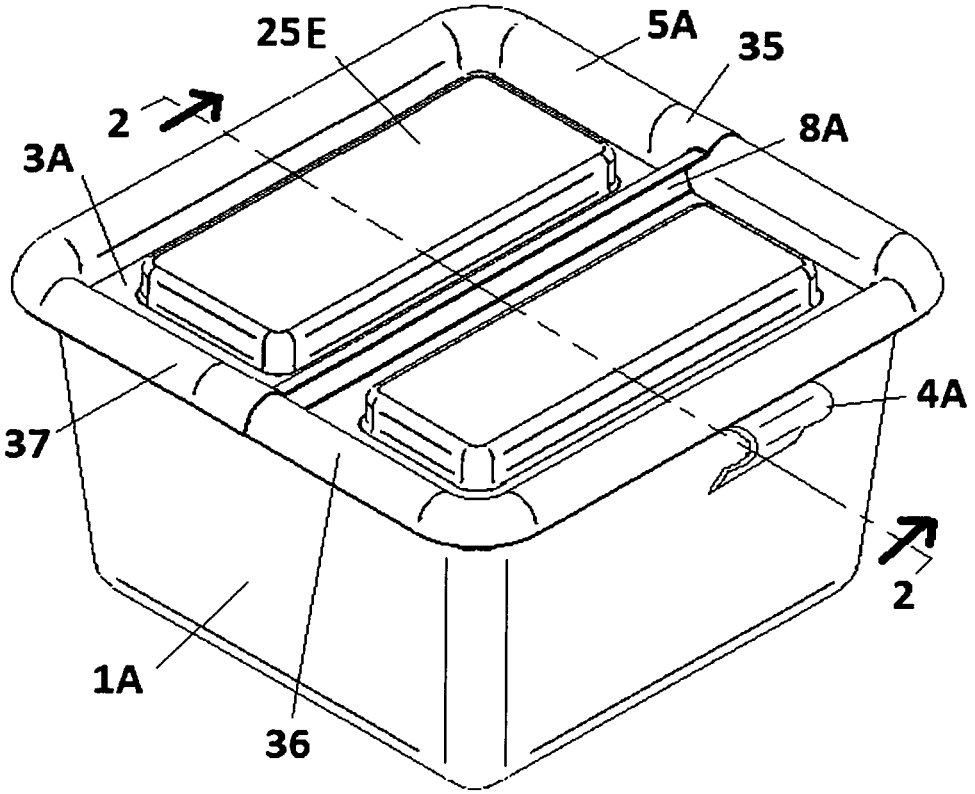

FIG. 1 depicts an isometric view of a container 1A with both covers 36 and 37 in the closed position. There are raised elements 25E in the center of each cover 3A which form a flat surface in the same plane as the top of the cover to cover link element 8A, so that other containers may rest upon a flat plane when stacked on a closed container. These raised elements 25E also serve to increase the rigidity of the cover 3A. Flexible connection members connect covers 3A to the container 1A. The perimeter seal element of the covers 5A overlap one another at the center area where they meet 35. Flexible connections 4A connect the covers 3A to the container 1A.

Figure 2:
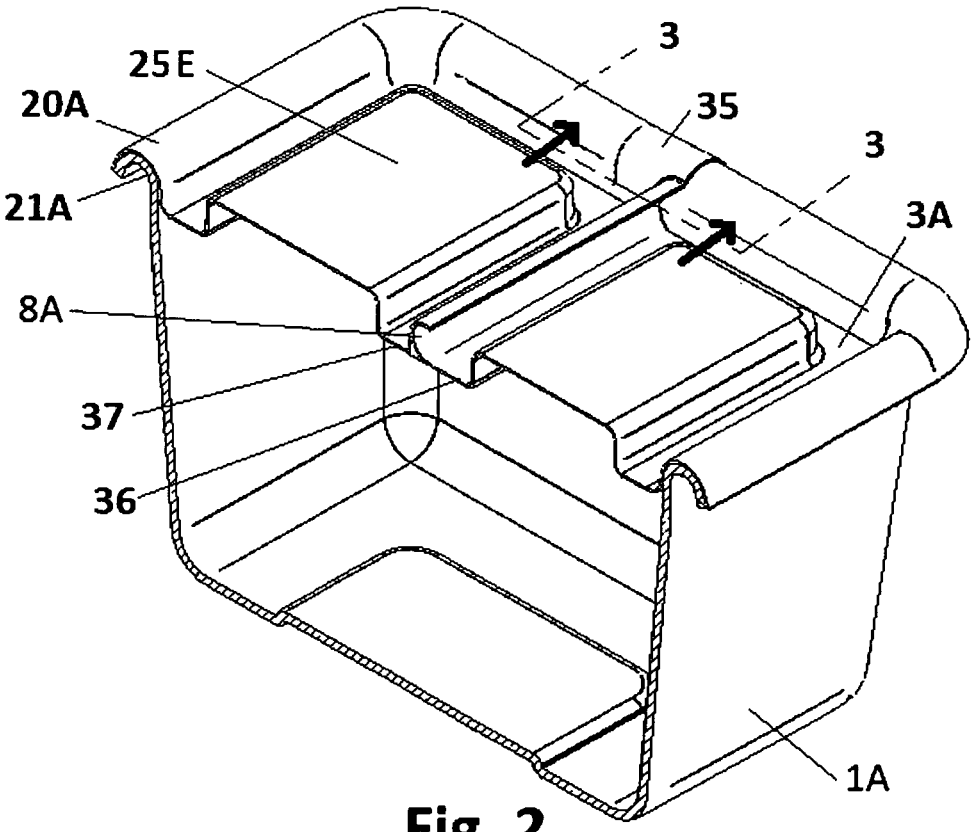
FIG. 2 depicts this same isometric view in cutaway section, exposing the cover to cover link element.

FIG. 2 depicts this same isometric view of FIG. 1 in cutaway section, exposing the cover to cover link element 8A where two lids 36 and 37 meet in the approximate center of the container 1A. Raised elements 25E in the covers 3A create a flat plane across the top of the container with both lids closed. Also visible is the formed edge of the container which forms a protrusion 21A designed to mate to the lid recess 20A. There is also a section where the perimeters of the two lids overlap 35.

Figure 3:
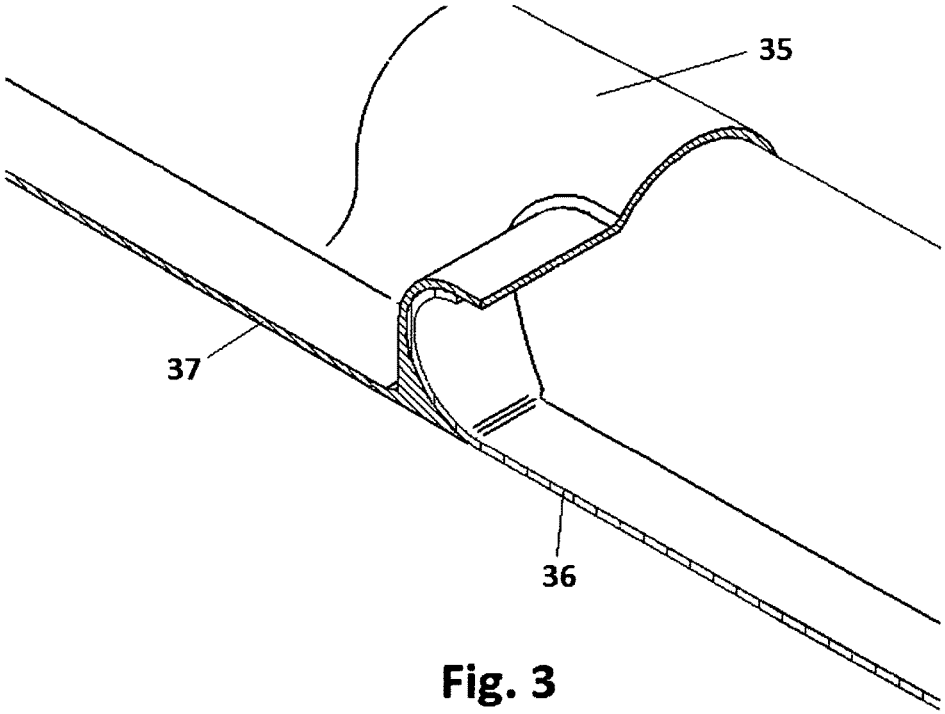
FIG. 3 depicts a blow up of the transition from the perimeter cover to container links, to the cover to cover link. It also shows where one perimeter cover to container link may overlap another perimeter cover to container link.

FIG. 3 depicts a blow up of the transition from the perimeter cover to container link/seal, to the cover to cover link seal. It also shows where one perimeter cover 37 links to another cover 36, and where the perimeter link/seals from covers to container overlap one another 35.

Figure 4:
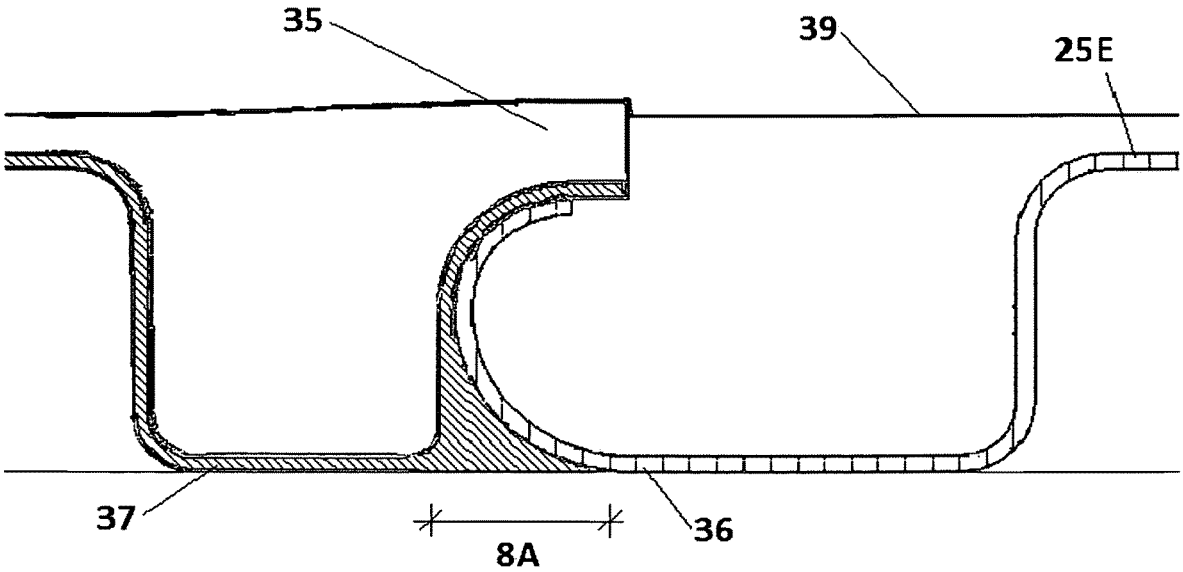
FIG. 4 depicts this same intersection in section view, showing the plane of the raised element of an individual lid in the same plane as the top of the cover to cover linking element, while the plane of the top of the perimeter cover to container link is higher, thus creating a perimeter ridge to capture the edge of a container stacked on top of this container with the covers closed.

FIG. 4 depicts this same intersection of multiple lids in section view, showing the plane of the raised element 25E of one individual lid 37 in the same plane as the top of the cover to cover linking element 8A, while the plane of the top of the perimeter cover to container link 39 is higher, thus creating a perimeter ridge to capture the edge of another container stacked on top of this container with the covers closed. There is an overlapping cover to cover link seal 35 at the perimeter.

Figure 5:
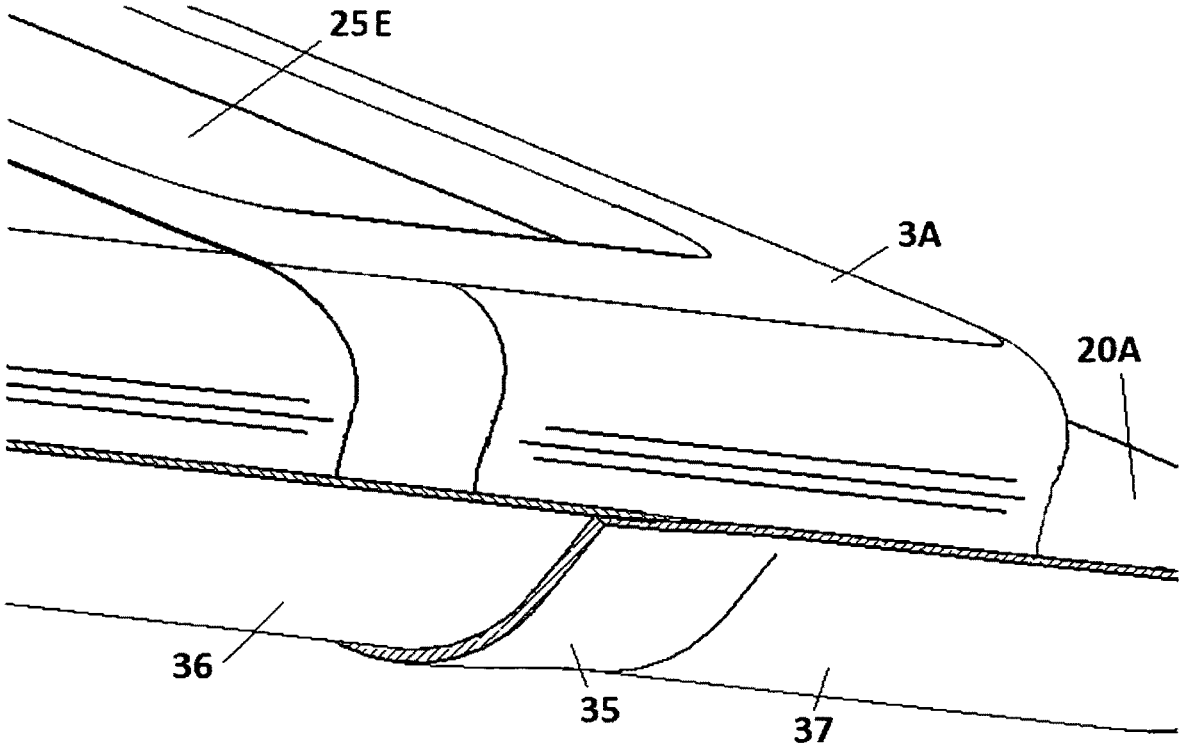

FIG. 5 depicts an underside viewpoint of the cover 36 to cover 37 transition, showing how the cover to cover transition creates a continuous connection recess 20A for the container edge condition to mate to. The raised element 25E is inverted in this view, and the bottom plane of the lid surface 3A is inverted. The overlapping section of the cover to cover intersection over the perimeter container seal is shown 35.

Figure 6:
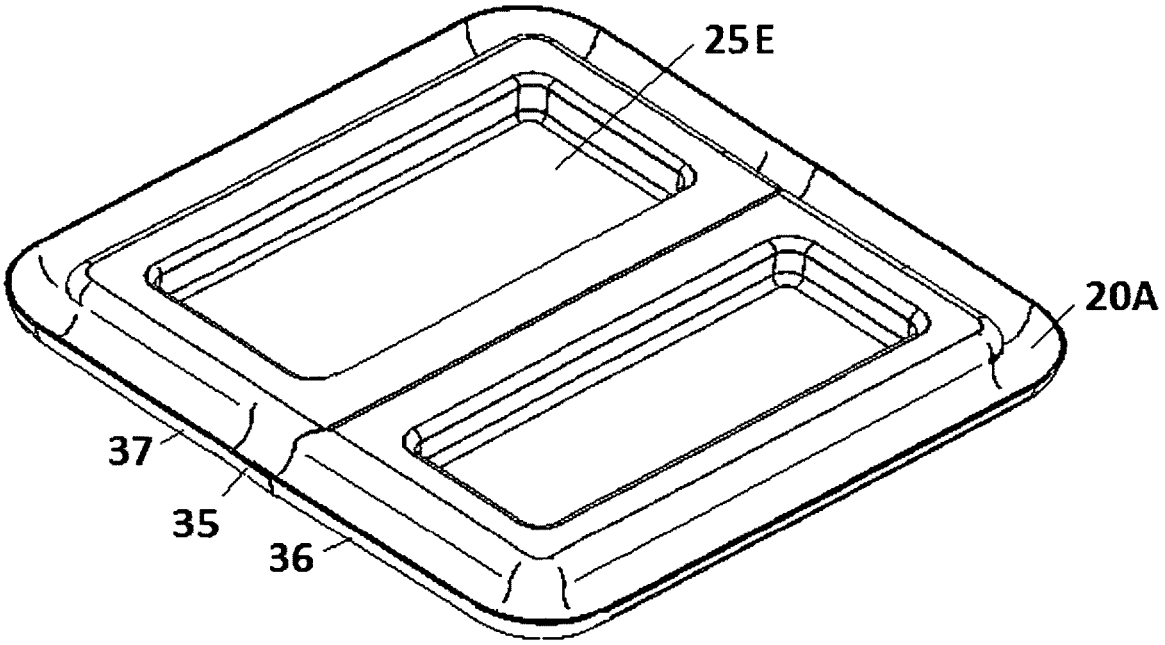
FIG. 6 depicts the underside of two covers connected together, without the flexible tabs or hinge elements shown for clarity.

FIG. 6 depicts the underside of two covers 36 and 37 connected together, without the flexible tabs or hinge elements shown for clarity. The recess 20A is continuous around the perimeter, and the raised element 25E is shown inverted. This shows the overlapping section of cover to cover seal 35 in an inverted view.

Figure 7:
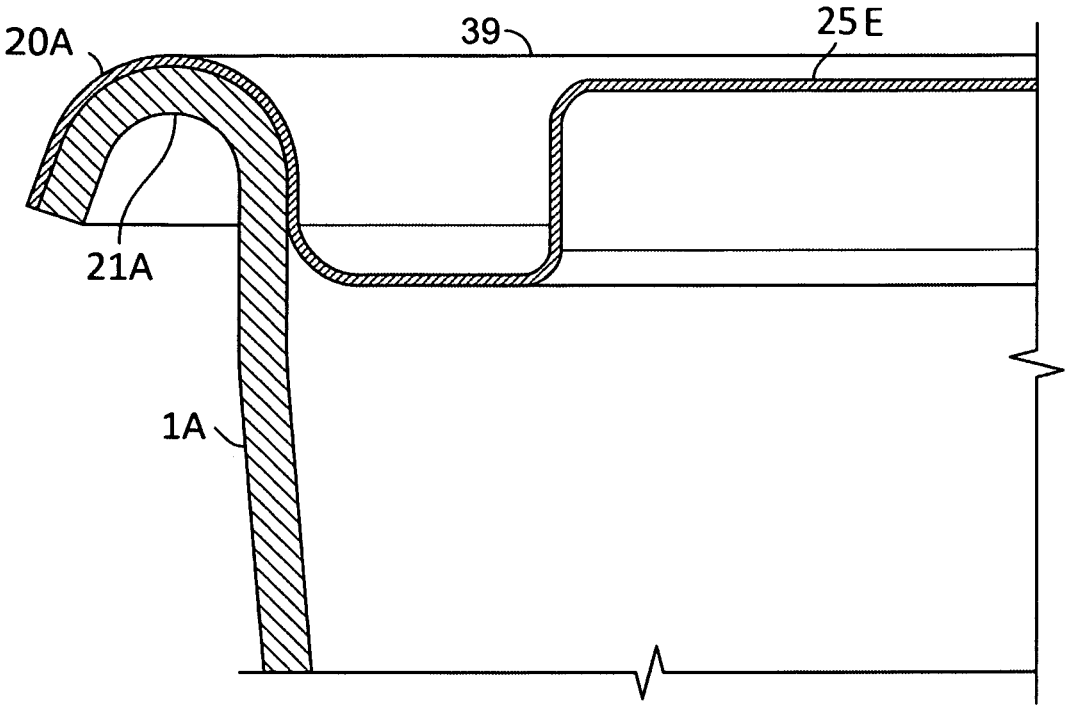
FIG. 7 depicts a section of the cover to container perimeter link, with the raised element shown in a lower plane than the perimeter link to create a perimeter ridge to capture other containers stacked above.

FIG. 7 depicts a container 1A with a section of the cover to container perimeter link, with the raised element 25E shown in a lower plane than the perimeter link 39 to create a perimeter ridge to capture other containers stacked above. Here the container edge protrusion 21A is shown mating to the container edge recess 20A.

Figure 8:
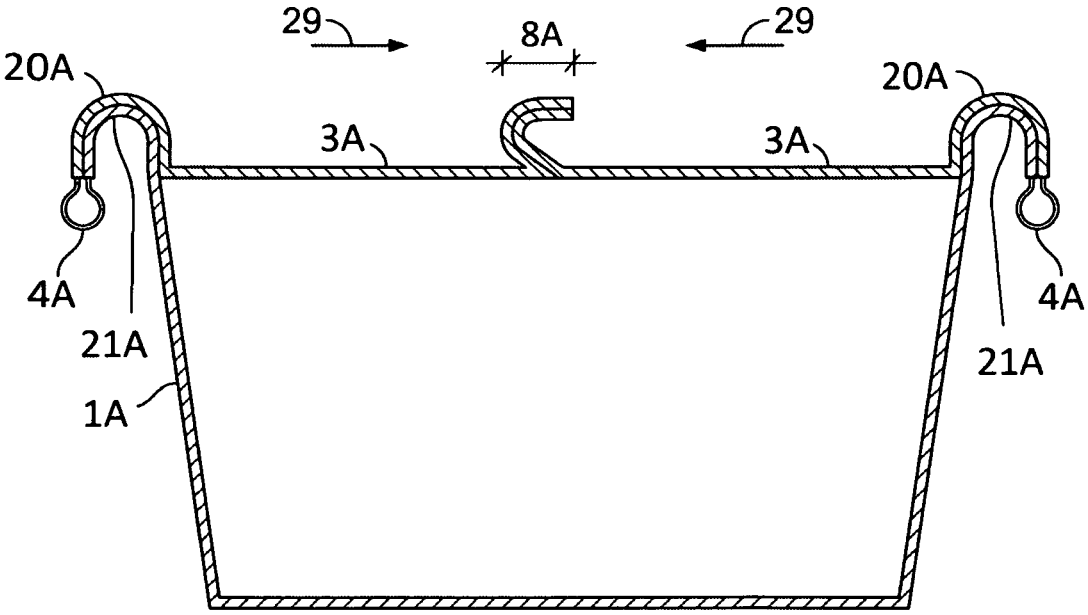
FIG. 8 shows section of a container where the central linking elements are pushed together with compression forces, where the linking element is above the plane of the cover which allows a user to pinch the covers closed from the top to seal them together.

FIG. 8 shows a container 1A where the central cover to cover sealing element 8A is a working in compression with the compression forces 29 shown. In this figure the recess portion of the cover to cover seal overlaps the protrusion portion essentially parallel to the orientation of the cover 3A. The arrangement of the protrusion and recess elements of the cover to cover link 8A allows the user to pinch the two together for a tight seal because both sides of the seal are above the covers 3A and accessible. There are flexible connections 4A from the covers 3A to the container 1A. The recessed portion 20A of the perimeter seal and the protrusion portion 21A of the perimeter seal are also shown.

Figure 9:
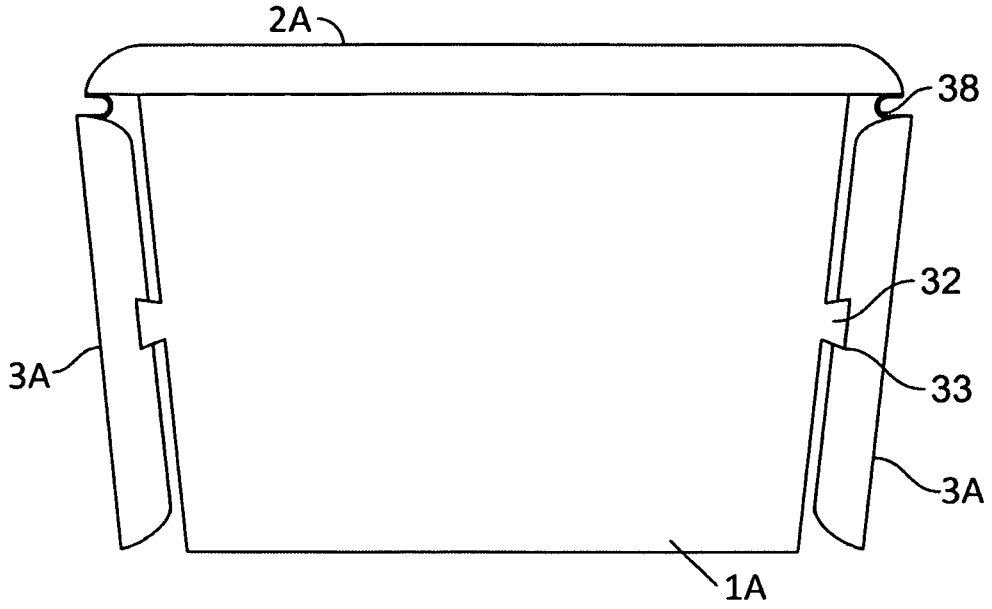
FIG. 9 shows an elevation of a container with multiple lids open and resting alongside the container bottom. It also shows a capture element in the form of a protrusion from the container sides, which can mate with a recess in the top of a lid to hold the open cover to the side of the container.

FIG. 9 shows an elevation of a container 1A with multiple covers 3A open and resting alongside the container bottom. It also shows a capture element in the form of a protrusion 32 from the container sides, which can mate with a recess 33 in the top of a lid, to hold the open covers to the sides of the container for a neat appearance. The container perimeter link/seal element 2A is shown, along with the living hinge element 38.

FIG. 10 shows a perspective view of a round container 1A with the covers 3A closed and hooked together 11A. These covers 3A are also connected via a flexible member 4A to the container 1A, to ensure that the right covers 3A are always with the right container. This figure also shows the cover to cover seal 11A, and cover to container edge seal 12A.

FIG. 11 depicts this same multiple cover container 1A as in FIG. 10, in perspective view with a section cut through it. This shows the perimeter edge of the covers 3A sealing around the edge of the container 1A, and the hook configuration 11A of the multiple covers pulling on one another with tension forces as the covers are pulled over the outside edge 18A of the container 1A. In this embodiment the edge 12A of the cover 3A seals on the container 1A edge 18A by compressing over it. The overlap of the container edges where they join together is shown in more detail in FIG. 17 and FIG. 18. The covers 3A are connected to the container 1A with a flexible connection element 4A.

FIG. 12 depicts a similar elongated "hook" type cover to cover sealing element 13A, with a cover 3A that simply overlaps the sides of the container 1A. The covers 3A are connected to the container 1A with a flexible connection element 4A.

FIG. 13 shows a similar elongated "hook" type of cover to cover seal in perspective section, depicting the hooking element 14A, and showing the perimeter edges 13A of the covers overlapping over and sealing around the edge of the container 18A. In this figure the edge seal 13A of the cover doesn't sandwich over both sides of the container edge as is FIG. 10 and FIG. 11, rather, there is simply an edge that drops down around the outside edge of the container 18A. As the two lids pull against each other in tension to create a seal at the hooked area 14A, the outside perimeter of the lids also pull in tension towards the center and a seal is created at the overlapped area 13A. The covers 3A are connected to the container 1A with a flexible connection element 4A.

FIG. 14 depicts the container 1A depicted in FIG. 11 in elevation section view, showing the cover edge seal 12A of a cover 3A over the edge of the container 1A, and the flexible connection elements 4A connecting the covers 3A to the container 1A. This also shows the hook type seal of the cover to cover seal 11A working in tension forces 28A.

FIG. 15 depicts the embodiment of FIG. 12 in elevation section view, showing an elongated hook type cover to cover seal 14A in the center and the overlapping cover arrangement 13A over the edges of the container 1A. This also depicts the tension forces 28A pulling the cover to cover seal 14A together. The covers 3A are connected to the container 1A with a flexible connection element 4A.

FIG. 16 depicts an embodiment that features a hooked arrangement cover to cover seal 14A, in a configuration that keeps the top of the cover 3A flat to ease stacking of closed containers. The covers 3A are connected to the container 1A with a flexible connection element 4A. Also depicted is the overlap configuration of cover to container edge link/seal.

FIG. 17 depicts the overlapping perimeter edge seal of FIG. 10, FIG. 11, and FIG. 14 in more detail, where the two cover edge recesses 15A overlap each other to join together over the container edge protrusion. The edges are joined by beveling the leading edge 16A to allow the edge to compress tightly over the container edge without creating an open seam. There is a recess 15A in the female portion of the cover edge 24A which accepts a protrusion 22A on the male section 23A to lock into place holding the two sections together in compression which aids preventing the overlapping sections from pulling apart in tension. Also depicted is the recess at the edge of the cover 26A to receive the edge of the container.

FIG. 18 depicts the same overlapping seal 12A as in the FIG. 17 in side elevation, showing the smaller male element 23A of one cover seal fitting inside the larger female 24A element of the other cover edge seal. The bevel on the edge of the male part 16A helps create a tight seal at the join and prevent leaks. In this elevation you can see the line of the edge of the cover 18A running through the joined edge seals, and the hook arrangement 11A of the central portions of the covers 3A.

FIG. 19A depicts a container with the cover to cover hook seal 11A arrangement partially open. In this figure you can see the open cover 3A resting substantially to the side of the container 1A, with the flexible connection element 4A attaching the cover to the container. The arrow depicts the motion of closing this cover over the container. Also depicted is the cover to container edge link/seal 12A.

FIG. 198 depicts a container 1A with the cover to cover hook seal 11A arrangement being joined together in the center. Here you can see the motion of hooking one cover 3A into the other cover 3A at the hook seal location 11A, and then pulling the cover in an opposing direction to align over the perimeter edge seal 12A over the opposing container perimeter edge 18A. Also depicted is the flexible connection element 4A between the cover and the container.

FIG. 19C depicts a container 1A with the cover to cover hook seal 11A arrangement being pressed down over the opposing container edge seal 12A. This motion of pulling over and down fully joins one cover to the other by pulling tension on the hook seal 11A, and it joins the now joined covers 3A to the container 1A. Also depicted is the flexible connection element 4A between the cover and the container.

FIG. 20 depicts an embodiment of the container 1A in a perspective view, showing the multiple covers 3A closed, and the flexible connection elements 4A connecting the covers to the container. There is a cover link/seal around the perimeter 5A to the container 1A, and a cover to cover link/seal 6A in the approximate center of the width of the container.

FIG. 21 depicts this same embodiment of the container 1A with the multiple covers 3A partially open. The perimeter sealing protrusion element of the container 2A is shown, as well as the perimeter sealing recess element of the covers 5A which fits over the protrusion portion 2A. This figure shows the cover to cover protrusion and recess link seal 6A of the covers, which when closed line up in the approximate center of the container 1A. Also depicted is the flexible connection element 4A between the cover and the container.

FIG. 22 depicts this same embodiment of the container 1A with the covers 3A fully open to either side of the container, allowing them to rest vertically on either side of the container 1A and therefore taking up minimal additional space on whatever surface (i.e. a table or counter) the container is placed on. This figure again shows the flexible connection elements 4A, the protrusion perimeter sealing element of the container 2A, the recess edge seal of the covers 5A, and the cover to cover sealing element 6A.

FIG. 23 shows a section through the container 1A in perspective view, showing the overlapping covers 3A closed, with the cover to cover protrusion and recess seal 6A in essentially the middle of the container. It also shows the flexible connection elements 4A, and the perimeter recess seal of the cover 5A fitting over the protrusion perimeter seal of the container 2A.

FIG. 24 shows a section of the container 1A, depicting the multiple covers 3A with an overlapping cover to cover seal element 17A in the approximate center with a locking tab 19E, which when pulled opens up the recess element 20A to allow the protrusion element 21A to be released. This operation is shown in more detail in FIG. 25A, FIG. 25B, and FIG. 25C. The lids also depict the raised elements 25E to create a flat plane at the top surface when closed. The container 1A shows the protrusion portion of the perimeter edge seal 2A, along with the flexible connection elements 4A connecting the covers 3A to the container 1A.

FIG. 25A depicts the locking seal arrangement shown FIG. 24 as the central cover 3A to cover sealing arrangement (noted as 17A in FIG. 24) in an expanded view with the recess portion 20A over the protrusion element 21A. In this detail the geometry of the connection shows the recessed portion closing over and slightly around the protrusion portion, which when closed will resist separation. There is a tab element or elongated edge 19E which when pulled will open the recess 20A to accept the protrusion 21A.

FIG. 25B depicts the locking seal arrangement with the recess element 20A of a cover 3A being pressed over the protrusion element 21A and widening the opening in the recess element. You can see the elongated tab element 19E being forced away from the protrusion element 21A to allow the opening in the recess element 20A to widen to the point of overlapping the protrusion element as the recess element is pressed down.

FIG. 25C depicts the locking seal arrangement with the recess element 20A of a cover 3A being pressed fully over the protrusion element 21A, showing the opening in the recess element 20A closing over and slightly around the protrusion element 21A as the elongated tab element 19E now retracts inwards towards the protrusion element 21A in a spring type of action due to the flexible material of the recess element 20A. This retraction forms a locking of the two elements in place, requiring the elongated tab 19E to be pulled out to help release the locked elements.

FIG. 26 shows three (3) separate containers in elevation view, showing their nesting capability with the covers 3A attached by living hinge elements 38. Multiple containers 1A can be stacked together with covers 3A attached and opened, utilizing a storage area only slightly larger than the containers themselves.

FIG. 27 shows a container 1A in section view, with flexible gasket elements 34 in various locations such as the cover 3A to container edge location 12A, or cover to cover location 11A. Also depicted is the flexible connection element 4A between the cover and the container.

FIG. 28 shows an alternate embodiment of the covers 3A with the perimeter sealing arrangement in a reversed layout. The container 1A perimeter seal is a recess 20A and the cover link/seal 21A fits within. The covers 3A a're connected to the container 1A with living hinges 38. This embodiment also features at least one latching element 30, which can be pulled over a counter attachment (or latch) element 31 on the opposing lid. This serves as another connection element between a plurality of covers to keep them from separating. Also depicted is the reversed cover to cover link/seal element 9A.

Operation

FIGS. 20, 21, and 22 depict the operation of the recess and protrusion elements in the closed, partially open, and open conditions. Essentially, the covers 3A are placed over the edge seals 2A. One cover is pushed down first with the central protrusion element. The other cover with a recess element at the center link/seal is then pushed over the container edge 2A and the other covers protrusion element, thus overlapping and linking to the other cover. There are various configurations of the link element between the covers and the container, or between a cover and another cover that can be utilized.

FIG. 10, FIG. 11, FIG. 12, and FIG. 13 depict edge seal conditions utilizing tension in the plurality of covers to create a cover to cover seal. The edge seal condition can be various configurations, such as an overlapped seal as in FIG. 13, or a protrusion and recess seal such as FIG. 11. In this arrangement, the two covers are hooked together 11A, and then the edge seal is pushed down around the edge of the container. This provides a tension element across the cover to cover seal 11A, "pulling" the elements tightly together, providing the seal.

FIG. 19A, FIG. 19B, and FIG. 19C depict this type of operation in section and in sequence.

FIG. 19A depicts the container 1A with one of the covers 3A partially on, and the other cover 3A open and resting to the side. The flexible connection element 4A holds the open cover 3A to the container 1A.

FIG. 19B depicts the second cover 3A hooking 11A into the first cover 3A and then pulling towards the opposing container edge 18A. Here the arrow depicts the hooking motion, and then pulling the opposing cover 3A away from the other cover 3A.

FIG. 19C depicts the second cover 3A now hooked to the first cover 3A and being pressed down onto the container 1A.

FIG. 26 depicts the nesting nature of a plurality of containers with the open covers attached. This nesting arrangement is suitable for either round, square/rectangular, or other shapes of containers. Because there is more than one covers, each cover be ½ or less in width as the depth of the container. This allows the covers to rest virtually alongside a single container when opened, and allows multiple containers with open covers to stack and nest within one another without needing to remove the attachment of the covers.

FIG. 25A, FIG. 25B, and FIG. 25C depict the operation of a protrusion and recess link/seal arrangement, where the recess clamps over the protrusion, thus locking them together. This features an elongated tab to pull the recess portion open to couple and de-couple it from the protrusion element. In FIG. 25A you can see the recess link/seal element 20A curve of one cover 3A closes to an opening not big enough to fit over the protrusion seal element 21A of another cover 3A. In FIG. 25B as the recess element 20A of one cover 3A is pressed down upon the protrusion element 21A of an alternate cover 3A, and the recess element 20A curve is forced to open to a larger size. The tab element 19E is pushed outward, away from the protrusion seal element 21A. In FIG. 25C as the recess seal element 20A of one cover 3A is pushed down fully, the curve closes again over the protrusion element 21A of an alternate cover 3A, where the tab element 19E retracts inward towards the protrusion element 21A. This is now "locked" or snapped into place over the protrusion element. In order to release the recess cover element 20A the tab element 19E of this cover 3A needs to be pulled away and up from the protrusion element 21A of the alternate cover 3A.

What is claimed is:

1. A container, comprising:

a container bottom comprising:

a container base, a container side extending upwards from a periphery of the container base, the container side defining a continuous sidewall, the container side comprising a perimeter edge opposite the container base, and an opening defined by the perimeter edge of the container side; and at least two lids, wherein each lid of the at least two lids individually smaller than the opening, and wherein each lid of the at least two lids together configured to cover the opening, the at least two lids comprising a first lid and a second lid, the first lid comprising:

a perimeter edge of the first lid configured to engage sealably a first portion of the perimeter edge of the opening, and a first cover link element, and the second lid comprising:

a perimeter edge of the second lid configured to engage sealably a second portion of the perimeter edge of the opening, and a second cover link element, wherein the perimeter edge of the first lid and the perimeter edge of the second lid are shaped to engage the entirety of the perimeter edge of the container side sealably in a container to lid engagement, wherein the first cover link element and the second cover link element are shaped to engage each other sealably, in a lid to lid engagement, wherein the first cover link element and the second cover link element are shaped to engage each other in tension or in compression in a horizontal direction, and wherein the lid to lid engagement and the container to lid engagement form a continuous seal between the at least two lids, and between the at least two lids and the container bottom.

2. The container of claim 1, wherein, when the first lid and the second lid are engaged, the lid to lid engagement is located within the opening, and the lid to lid engagement is in a plane different from a portion of the first lid not comprising the first cover link element, and a portion of the second lid not comprising the second cover link element.

3. The container of claim 1, wherein the engagement of the first cover link element and the second cover link element comprises a first flexible gasket element configured to be sandwiched between the first cover link element and the second cover link element upon being engaged, wherein the first flexible gasket element enhances the seal therebetween.

4. The container of claim 1, wherein the perimeter edge of the first lid and the perimeter edge of the second lid overlap at an overlap portion, forming a seal in the overlap portion.

5. The container of claim 4, wherein the lid to lid engagement of the first cover link element and the second cover link element interfaces with the overlap portion.

6. The container of claim 5, wherein the interface has an elongated hook shape.

7. The container of claim 1, further comprising at least two flexible connection elements formed between the container side and the at least two lids, respectively, each flexible connection element configured to secure each lid of the at least two lids to the container side, while allowing each lid room for movement.

8. The container of claim 7, wherein said lid to container bottom flexible connection is a hinge element.

9. The container of claim 7, wherein at least one of the at least two flexible connections is removable.

10. The container of claim 1, wherein at least one of the at least two lids comprises at least one raised platform at a same or higher level than the lid to lid engagement over the opening.

11. The container of claim 1, further comprising at least two attachment elements protruding from the container side, each of the at least two attachment elements corresponding to each of the at least two lids, wherein each of the at least two lids has a recess therein to mate with the corresponding attachment element, and wherein each lid of the at least two lids has a dimension equal to or less than the depth of the container bottom.

12. The container of claim 1, wherein the first cover link element and the second cover link element engagement comprises a recess shape to receive a human finder to allow manipulation of at least one of the first cover link element or the second cover link element by the human finger, when the first lid and the second lid are engaged sealably over the container bottom.

13. The container of claim 1, wherein the engagement of the first cover link element and the second cover link element comprises a first flexible gasket element configured to be sandwiched between the first cover link element and the second cover link element upon being engaged, wherein the first flexible gasket element enhances the seal therebetween.

14. The container of claim 1, wherein the engagement of the perimeter edge of the first lid and the first portion of the perimeter edge of the opening comprises a second flexible gasket element configured to be sandwiched between the perimeter edge of the first lid and the first portion of the perimeter edge of the opening upon being engaged, wherein the second flexible gasket element enhances the seal therebetween.

15. The container of claim 1, wherein the container side extends outwards from the container base.

16. The container of claim 1, wherein the container bottom comprises at least one of glass, resin, cellulose, foam, or bioplastic, and wherein the at least two lids comprise at least one of plastic, or rubber.

17. The container of claim 1, wherein the first cover link element and the second cover link element are shaped to engage each other in tension or in compression in a horizontal direction.

18. The container of claim 1, wherein when the first lid and the second lid are engaged, the lid to lid engagement is located within the opening, and the lid to lid engagement is in a plane different from a portion of the first lid not comprising the first cover link element, and a portion of the second lid not comprising the second cover link element.

* * * * *